US005259819A

United States Patent [19]

Lee

[11] Patent Number: 5,259,819

[45] Date of Patent: Nov. 9, 1993

[54] METHOD OF MANUFACTURING A WASHER

[76] Inventor: Wen-Yuan Lee, 7F-3, No. 8, Lane 390, Sec. 1, Chien-Kang Rd., Tainan City, Taiwan

[21] Appl. No.: 772,415

[22] Filed: Oct. 7, 1991

[51] Int. Cl.[5] ..... B21D 53/20

[52] U.S. Cl. ..... 470/41; 72/327

[58] Field of Search ..... 470/41, 162, 163, 147, 470/141, 121, 125, 130; 72/300, 311, 312, 327

[56] References Cited

U.S. PATENT DOCUMENTS

| | | | |
|---|---|---|---|
| 641,255 | 1/1900 | Atkins | 470/130 |
| 677,883 | 7/1901 | Neider | 470/41 |
| 1,983,618 | 12/1934 | Lamond | 470/141 |
| 2,829,388 | 4/1958 | Dzama | 470/40 |
| 3,036,318 | 5/1962 | Chatfield | 470/41 |
| 4,435,973 | 3/1984 | Nakazawa et al. | 72/327 |

*Primary Examiner*—Lowell A. Larson
*Assistant Examiner*—Michael J. McKeon

[57] ABSTRACT

A method of manufacturing a washer includes the steps of: (a) feeding a metal wire into a die having a bearing face and a through hole which opens to the bearing face so as to permit the metal wire in the through hole to protrude out of the bearing face at a predetermined length; (b) punching the protruded metal wire against the bearing face to form a disc with a punching head which includes a core and a shell; (c) punching the disc to form a central hole on the disc by forcing the core out of said shell and into the through hole; and (d) retracting the punching head to allow the disc to separate from the metal wire.

2 Claims, 3 Drawing Sheets

METHOD OF MANUFACTURING A WASHER

BACKGROUND OF THE INVENTION

1. Field of the Invention

This invention relates to a method of manufacturing a washer, more particularly to an improved method of manufacturing a metal washer.

2. Description of Related Art

A washer is generally used to improve the tightness of a screw fastener. Referring to FIG. 1, conventional washers (A1) are manufactured by punching a metal strip (A) with a punching machine. The scrap portions (T) of the metal strip (A) are discarded. Referring to FIG. 2, in order to increase the material efficiency of the metal strip (A) and to reduce the scrap portion (T), the washers (A1) removed from the metal strip (A) are arranged in three lines, the washers (A) in one line being staggered relative to the washers (A) in the other lines. The washers may be positioned in at least four lines in a similar staggered arrangement. However, the material efficiency of the metal strip (A) is always below 50%. Therefore, the above punching method is inefficient since large amounts of the metal strip (A) are wasted. Correspondingly, the manufacturing costs for the washers (A) are high.

SUMMARY OF THE INVENTION

Therefore, the object of this invention is to provide an improved method of manufacturing a washer which can effectively reduce the manufacturing costs thereof and improve the physical property of the washer.

Accordingly, a method of manufacturing a washer of this invention includes the steps of: (a) feeding a metal wire into a die having a bearing face and a through hole which opens to the bearing face so as to permit the metal wire in the through hole to protrude out of the bearing face at a predetermined length; (b) punching the protruded metal wire against the bearing face to form a disc with a punching head which includes a core and a shell; (c) punching the disc to form a central hole thereon by forcing the core out of said shell and into the through hole of the die; and (d) retracting the punching head to allow the disc to separate from the metal wire.

In addition, the disc with the central hole has a metallographic structure with a plurality of radial stream lines.

BRIEF DESCRIPTION OF THE DRAWING

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
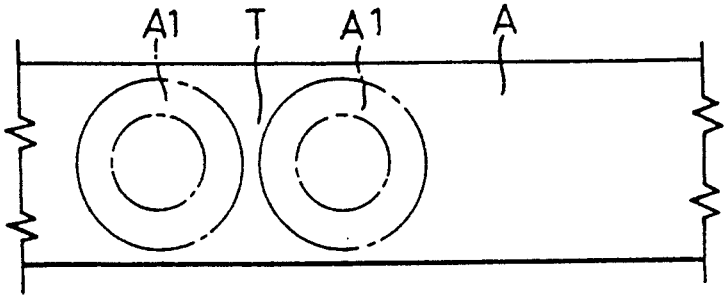
FIG. 1 (PRIOR ART)
FIGS. 1 and 2 are schematic views showing that washers are manufactured by conventional punching methods.
Figure 2:
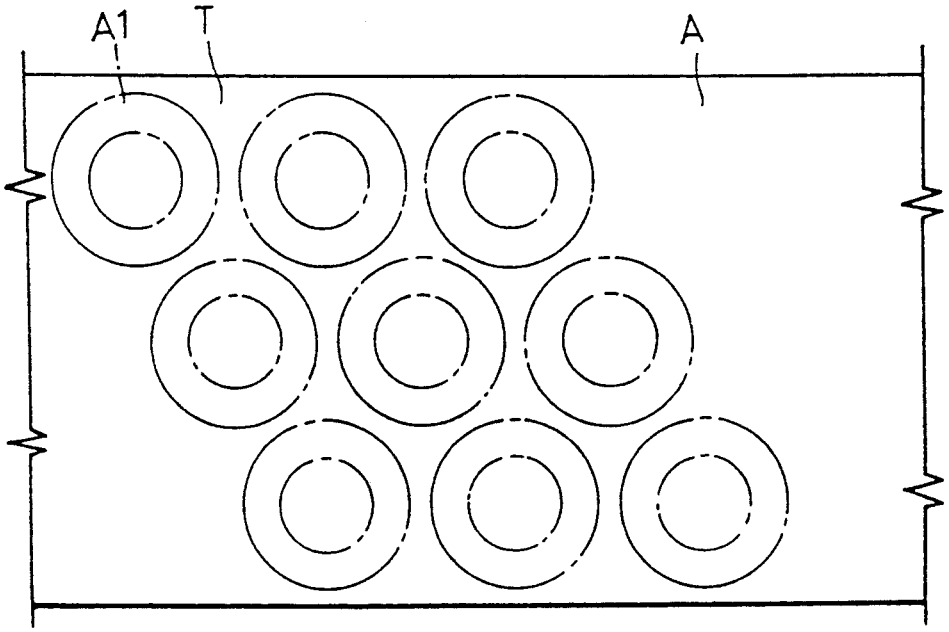
FIG. 2 (PRIOR ART)
Figure 3:
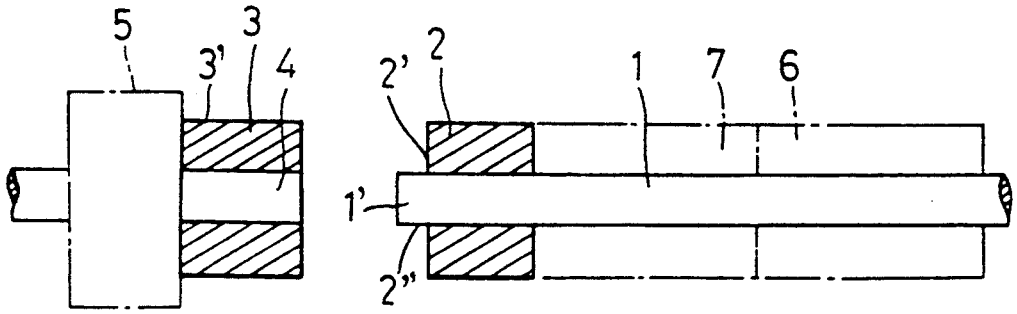
FIG. 3 is a schematic view showing that the metal wire is fed into the die to protrude out of the bearing face at a predetermined length.
Figure 4:
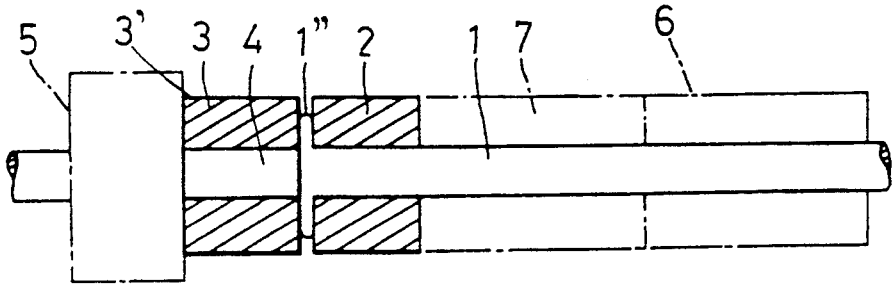
FIG. 4 is a schematic view showing that the protruded metal wire is punched against the bearing face to form a disc with a punching head.
Figure 5:
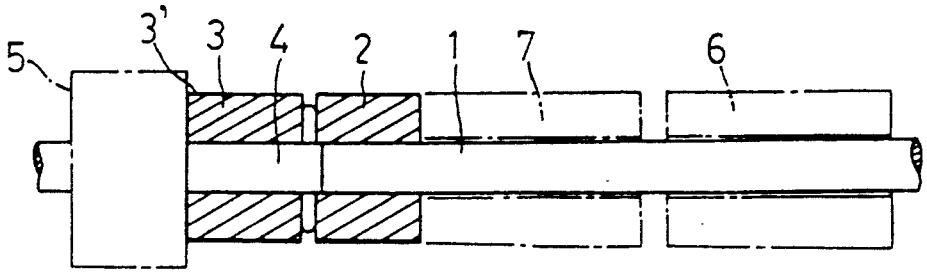
FIG. 5 is a schematic view showing that the disc is punched to form a central hole thereon by forcing the core into the bore.
Figure 6:
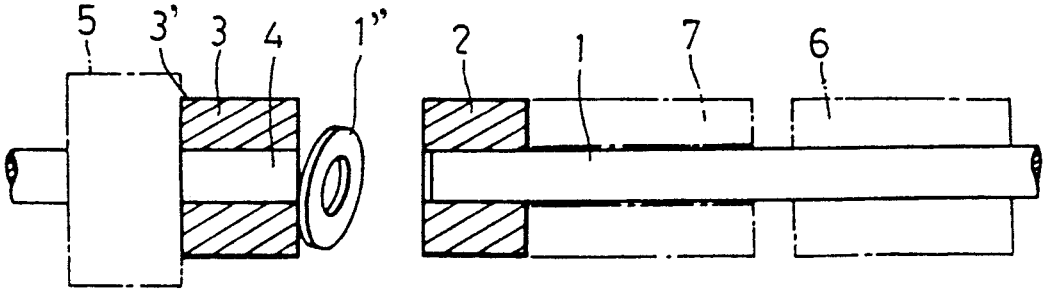
FIG. 6 is a schematic view showing that the punching head is moved away from the die and the disc is separated from the metal wire.

Referring to FIGS. 3 to 6, a preferred embodiment of a method of manufacturing a washer of this invention uses a die (2) which has a bearing face (2') and a through hole (2'') opening to the bearing face (2'), a stationary clamp (7) adjacent to the die (2), a moving clamp (6) adjacent to the stationary clamp (7), a punching head (3') which has a shell (3) and a core (4), and a driving device (5) which alternatingly moves the punching head (3') towards and away from the die (2) and moves the core (4) relative to the shell (3). The core (4) has a cross-section substantially similar to the cross-section of the through hole (2'') of the die (2).

The preferred embodiment includes the step of feeding a metal wire (1) into the die (2) through the through hole (2) in order to permit the metal wire (1) to protrude out of the bearing face (2') at a predetermined length. The length of the metal wire (1) to be projected from the bearing face (2') can be determined according to the thickness and the cross-section of the required washer. The feeding step includes: (a) advancing the metal wire (1) into the through hole (2'') by the moving clamp (6), and (b) positioning the metal wire (1) with the stationary clamp (7). The protruded metal wire (1') is punched against the bearing face (2') to form a disc (1'') with the punching head (3') actuated by the driving device (5). The stroke of the punching head (3') is controlled in such a way that the punching head (3') stops at a predetermined distance from the bearing face (2') of the die (2). The stationary clamp (7) and the moving clamp (6) release the metal wire (1). The disc (1'') is punched to form a central hole thereon by forcing the core (4) out of said shell (3) and into the through hole (2'') by the driving device (5). The moving clamp (6) and the punching head (3') are respectively moved away from the die (2). The disc (1'') with the hole is separated from the metal wire (1). The moving clamp (6) then clamps the metal wire (1) and moves toward the stationary clamp (7) so as to feed the metal wire (1) again. The stationary clamp (7) clamps the metal wire (1) again in order to manufacture another washer.

The scrap portion of the metal wire (1) is very small. The material efficiency of the metal wire (1) is about 100%. Therefore, the manufacturing cost of the washers by the method of this invention is greatly reduced and is much lower than the prior art manufacturing cost.

Figure 7:
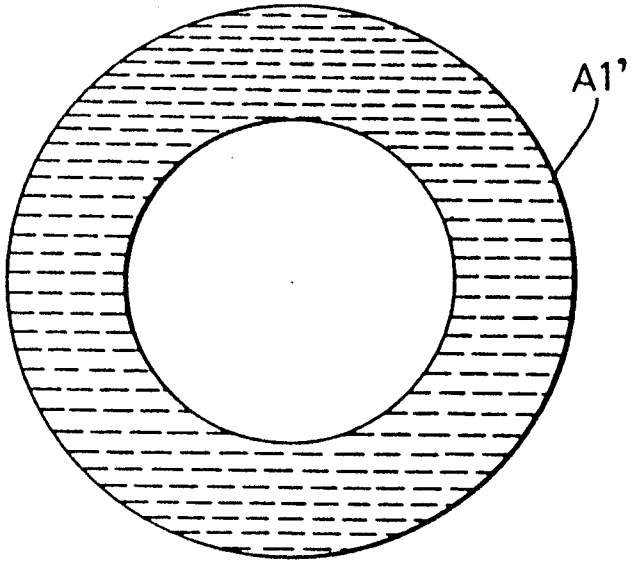
FIG. 7 (PRIOR ART)
FIG. 7 is a schematic plan view of the conventional metal washer which has a metallographic structure with stream lines parallel to one another.

Referring to FIG. 7, a conventional metal washer (A1') has a metallographic structure with stream lines parallel to one another. The metal washer (A1') is susceptible of being ruptured along the stream lines when subjected to stress.

Figure 8:
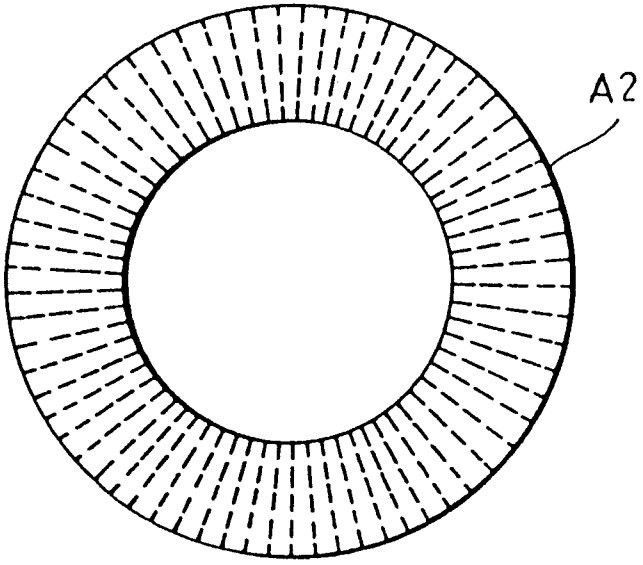
FIG. 8 is a schematic plan view of the metal washer of this invention which has a metallographic structure with a plurality of radial stream lines.

Referring to FIG. 8, a metal washer (A2) manufactured by this invention has a metallographic structure with a plurality of radial stream lines. The metal washer (A2) is not easily ruptured when subjected to stress. Furthermore, the process of this invention provides a work hardening effect, so that the metal washer produced has a good resistance against deformation.

Figure 9:
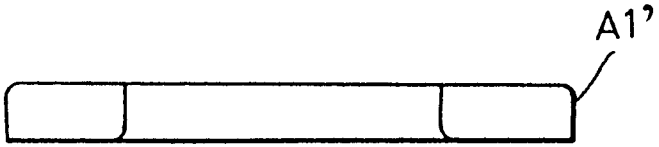
FIG. 9 (PRIOR ART)
FIG. 9 is a schematic sectional view of the conventional metal washer.
Figure 10:
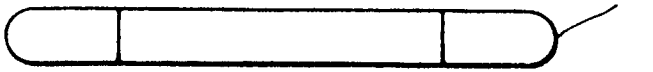
FIG. 10 is a schematic sectional view of the metal washer of this invention.

FIG. 9 shows the metal washer (A1') produced conventionally has a burr on its outer and inner edges. FIG. 10 shows that the metal washer (A2) produced by this invention has round outer edges and a smooth inner rim.

Therefore, the metal washer (A2) manufactured by the method of this invention has a better physical property than the conventional metal washer (A1').

While the present invention has been described in connection with what is considered the most practical and preferred embodiment, it is understood that this invention is not limited to the disclosed embodiments, but is intended to cover various arrangements included within the spirit and scope of the broadest interpretations and equivalent arrangements.

I claim:

1. A method for manufacturing a washer, comprising the steps of:

providing a one-piece die having a downstream bearing face, an upstream end and a through hole extending from said downstream bearing face to said upstream end;

providing a stationary clamp adjacent to said upstream end of said die;

providing a moving clamp operatively positioned adjacent to said stationary clamp;

advancing a metal wire by means of said moving clamp through said stationary clamp and said upstream end until a predetermined length of said metal wire protrudes out of said downstream bearing face via said through hole;

clamping said metal wire by means of said stationary clamp so as to position said metal wire in said die;

operating a punching head with a core and a shell so as to punch said protruding length of said metal wire against said downstream bearing face in order to form a disc;

releasing said stationary clamp from the metal wire; and forming a central hole in said disc by forcing said core out of said shell and into said through hole.

2. The method as claimed in claim 1, and further including the step of:

moving said moving clamp rearward after said disc is separated; and clamping said metal wire with said moving clamp and moving said moving clamp toward said stationary clamp for advancing said metal wire.

* * * * *